United States Patent [19]

Weisenthal

[11] 3,978,555

[45] Sept. 7, 1976

[54] CLOSURE MEMBER FOR BALLOONS

[76] Inventor: Marvin L. Weisenthal, 2169 Eastman, West Bloomfield Hills, Mich. 48033

[22] Filed: Jan. 6, 1975

[21] Appl. No.: 538,809

Related U.S. Application Data

[63] Continuation-in-part of Ser. No. 420,264, Nov. 29, 1973, Pat. No. 3,900,989.

[52] U.S. Cl. ..... 24/255 SL; 46/90

[51] Int. Cl.[2] ..... A44B 21/00; A36H 3/06

[58] Field of Search ..... 24/255 SL, 255 R, 255 BC, 24/30.5 R, 248 SL, 248 HC, 248 PC, 248 HE, 73 LF; 132/48 R, 46 R; 251/10; 46/87, 90; 128/325, 346

[56] References Cited

UNITED STATES PATENTS

| | | | |
|---|---|---|---|
| 600,887 | 3/1898 | Pettit | 24/259 A UX |
| 1,376,613 | 5/1921 | Forsell | 24/259 A |
| 1,459,735 | 6/1923 | Kraft | 24/30.5 R |
| 1,870,014 | 8/1932 | Laughton | 24/259 A UX |
| 2,498,372 | 2/1950 | Kartcucke, Jr. et al. | 128/346 |
| 3,094,807 | 6/1963 | Dorman | 46/90 |
| 3,595,249 | 7/1971 | Solomon | 24/248 HC |
| 3,739,525 | 6/1973 | Rybak | 24/255 SL X |
| 3,755,859 | 9/1973 | Solari | 24/255 SL |
| 3,860,014 | 1/1975 | Clifton | 132/46 R |
| 3,874,042 | 4/1975 | Eddleman et al. | 24/255 SL |

FOREIGN PATENTS OR APPLICATIONS

| | | | |
|---|---|---|---|
| 501,059 | 2/1939 | United Kingdom | 24/259 A |
| 826,308 | 10/1957 | United Kingdom | 132/48 R |

*Primary Examiner*—Donald A. Griffin
*Attorney, Agent, or Firm*—Basile and Weintraub

[57] ABSTRACT

A closure member for sealingly closing the neck of an inflated balloon includes a pair of legs interconnected by a hinge. One of the legs is substantially linear while the other leg has an arcuate section. Complementary sealing channels and grooves are provided on the interior surfaces of the legs. A lock sealingly closes the legs together.

3 Claims, 5 Drawing Figures

CLOSURE MEMBER FOR BALLOONS

CROSS-REFERENCE TO RELATED APPLICATIONS

This application is a continuation-in-part application of copending U.S. Pat. application Ser. No. 420,264, filed Nov. 29, 1973, and entitled "BALLOON CLAMP", now U.S. Pat. No. 3,900,989, the disclosure of which is hereby incorporated by reference.

BACKGROUND OF THE INVENTION

1. Field of the Invention

The present invention pertains to closure members or devices. More particularly, the present invention pertains to closure devices for inflatable objects. Even more particularly, the present invention relates to a closure device for a balloon which is deployed exteriorly of the balloon.

2. Prior Art

In the above-referred to copending application there is disclosed a balloon clamp for sealingly closing the neck of an inflated balloon.

Although the device disclosed therein is efficacious, it has been found that in some instances there is an imperfect seal. This has been found to be attributable to some loss of compression between the legs of the clamp. The present invention, on the other hand, alleviates the problem.

SUMMARY OF THE INVENTION

In accordance with the present invention there is provided a balloon clamp for sealingly closing an inflated balloon about the neck thereof.

The clamp includes a first substantially linear leg and a second arcuate leg. The two legs are interconnected by a flexible hinge to render the legs freely rotatable. The device also includes complementary sealing means disposed on the opposed interior surfaces of the legs. Locking means locks the two legs together to sealingly close off a balloon enshrouded by the sealing means.

For a more complete understanding of the present invention reference is made to the following detailed description and accompanying drawing. In the drawing like reference characters refer to like parts throughout the several views in which:

DETAILED DESCRIPTION OF THE PREFERRED EMBODIMENT

Figure 1:
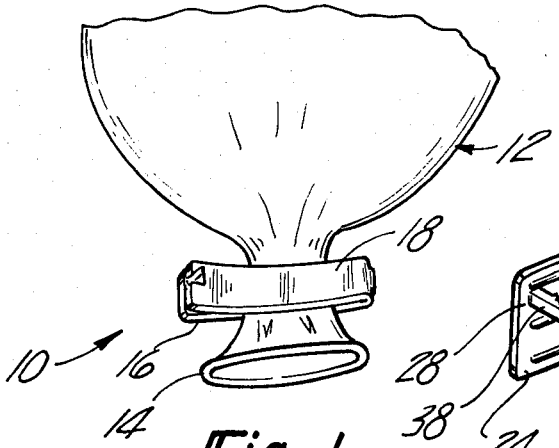
FIG. 1 is a perspective view showing the balloon clamp hereof and the deployment thereof.
Figure 2:
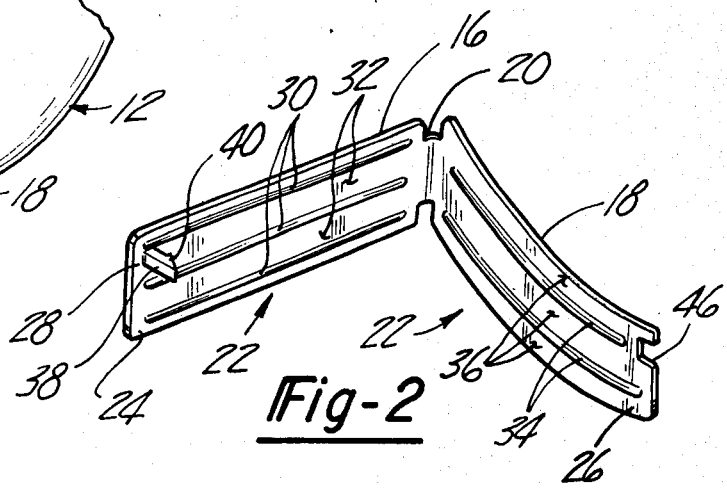
FIG. 2 is a perspective view of the balloon clamp of the present invention in an open position.
Figure 3:
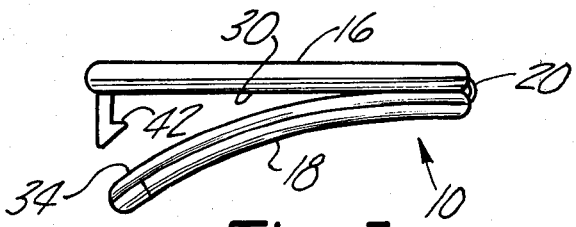
FIG. 3 is a side elevational view of the balloon clamp of the present invention in an unlocked position.

With reference to the drawing there is depicted therein a balloon clamp 10 which sealingly closes an inflated balloon 12 about the neck 14 thereof.

The clamp 10 generally comprises a first substantially linear leg 16 and a second arcuate leg 18. The two legs are interconnected at one end thereof by flexible hinge means 20. The hinge means 20 permits the legs to be, independently, freely rotatable. The device 10 further comprises complementary sealing means, generally, indicated at 22, provided on the interior surfaces 24, 26, respectively, of the legs 16, 18. The device 10, also, includes locking means generally indicated at 28 which permits the legs 16, 18 to be compressively locked together.

With more particularity, the present clamp 10 is a unitary clamp wherein the cooperation between the legs 16, 18 and the sealing means 22 provides a seal such that the fluid in the inflated balloon does not escape therepast.

Furthermore, it is critical hereto that one of the legs be substantially linear and the second leg be arcuate.

As noted, the present invention includes complementary sealing means 22 provided on the interior surface 24, 26 of legs 16, 18. The sealing means 22 on leg 16 comprises a plurality of projections 30 formed on the surface 24. The projections 30 extend substantially along the entire length of the leg 16 and are equidistantly spaced apart and substantially parallel to each other. By providing the projections 30 there is, thus, defined therebetween a plurality of channels 32.

The leg 18, also, includes a plurality of projections 34 provided on the surface 26 thereof. The projections extend substantially along the entire length of the leg 18 and are equidistantly spaced apart and substantially parallel to each other. The space between the projections and exteriorly thereof, also, define channels 36.

Figure 5:
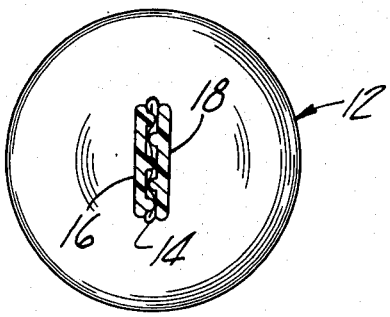
FIG. 5 is a cross-sectional view taken along the line 5—5 of FIG. 1.
Figure 4:
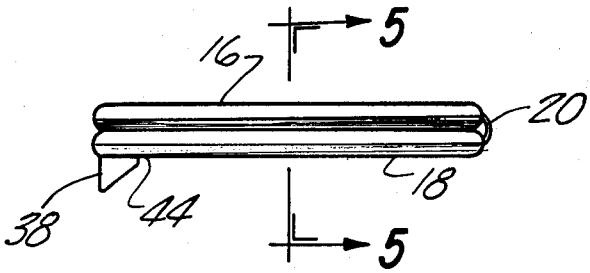
FIG. 4 is a side elevational view similar to FIG. 3, but showing the device in a locked position.

The projections 30 fit within the channels 35 and, likewise, the projections 34 fit within the channels 32 upon locking of the clamp. This cooperation between the channels and the projections enshrouds and sandwiches the neck 14 of the balloon 12 therebetween, as clearly shown in FIG. 5.

As hereinbefore noted, the locking means 28 compressively locks the legs 16, 18 together. Because of the arcuate configuration of the leg 18, the locking means pulls against the leg to force the engagement with the other leg thereby causing the compressive action.

The locking means 28 is disposed at the free or unhinged end of the legs 16, 18. The locking means 28 is a snap lock which includes a leg 38 integral with the leg 16 at one end thereof and having a chamfered shoulder 40 at its other end. The shoulder 40 has an undersurface 42 which defines a ridge which engages the exterior surface 44 of the leg 18 upon locking.

The second leg 18 includes a cut-out section 46 the inner edge of which terminates at a point such that upon contact thereof with the shoulder 40 there is engagement with the sloped surface of the shoulder.

To lock the two legs together, the inner edge of the cut-out section is slid down the sloped surface until it is past the terminus thereof and whereupon it snaps into engagement with the undersurface or ridge 42. In order to be completely efficacious the distance between the surface 24 and the undersurface 42 should be equal to or slightly less than the thickness of the leg 18.

The instant clamp 10 can be molded as an integral unit and is, preferably, formed from a rigid plastic, such as, polyethylene or the like.

Having, thus, described the invention what is claimed is:

1. In a closure member for sealingly closing an inflated balloon about the neck thereof of the type comprising first and second legs which receive the neck of the balloon transversely therebetween, the legs being interconnected by hinge means, the improvement which comprises:

a. a first substantially linear leg, b. a second arcuate leg, c. sealing means disposed on the opposed interior surfaces of the first and second legs, the sealing means sealingly closing the neck of the inflated balloon, d. locking means for compressively locking the two legs together, the locking means comprising: a leg extending from the linear leg and having a sloped shoulder at the free end thereof, the arcuate leg having a cut-out portion, the inner edge of which slides down the sloped shoulder until it engages the undersurface thereof, the locking means and cut-out portion being positioned to one side of a longitudinal line through the center of the closure member so as to provide a pull tab on the arcuate leg, the pull tab flaring away from the free end of the linear leg to facilitate release of the closure member from its locked condition, and wherein locking of the legs causes the sealing means to compressingly seal the balloon across the neck thereof to prevent the passage of fluid therefrom.

2. The improvement of claim 1 wherein the sealing means comprises:

a. a plurality of projections extending along the length of the first leg;

b. a plurality of channels disposed between the plurality of projections on the first leg;

c. a plurality of projections extending along the length of the second leg;

d. a plurality of channels disposed between and exteriorly of the projections on the second leg, and wherein the projections of the first leg fit into the channels of the second leg and the projections of the second leg fit into the channels of the first leg.

3. The improvement of claim 1 wherein the two legs are independently freely rotatable about the hinge means.

* * * * *